US012146397B2

(12) United States Patent
AlMutairi et al.

(10) Patent No.: US 12,146,397 B2
(45) Date of Patent: Nov. 19, 2024

(54) PORTABLE SYSTEM TO CAPTURE AND STORE LIQUID CARBON DIOXIDE

(71) Applicant: Saudi Arabian Oil Company, Dhahran (SA)

(72) Inventors: Saad AlMutairi, Dammam (SA); Khalid Mohammed M. Alruwaili, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/077,619

(22) Filed: Dec. 8, 2022

(65) Prior Publication Data

US 2024/0191607 A1 Jun. 13, 2024

(51) Int. Cl.
*E21B 43/267* (2006.01)
*E21B 43/26* (2006.01)

(52) U.S. Cl.
CPC ..... *E21B 43/2605* (2020.05); *E21B 43/2607* (2020.05); *E21B 43/267* (2013.01)

(58) Field of Classification Search
None
See application file for complete search history.

(56) References Cited

U.S. PATENT DOCUMENTS 6,729,409 B1 5/2004 Gupta
2008/0142226 A1* 6/2008 Wilson ..... E21B 37/06 166/177.5
2014/0151051 A1 6/2014 Lissianski et al.
2014/0352984 A1 12/2014 Enis
2016/0312108 A1 10/2016 Lestz
2017/0122089 A1 5/2017 De et al.
2020/0308947 A1 10/2020 Willson

FOREIGN PATENT DOCUMENTS

WO WO 2016075400 5/2016

OTHER PUBLICATIONS

Black et al., "Energized fracturing with 50% CO2 for improved hydrocarbon recovery," Journal of Petroleum Technology, 1982, 34(01): 135-140, 6 pages.
Jia et al., "Study of the influencing factors of the liquid CO2 phase change fracturing effect in coal seams," Plos one, 2021, 16(7), p. e0254996, 25 pages.

(Continued)

*Primary Examiner* — Andrew Sue-Ako
(74) *Attorney, Agent, or Firm* — Fish & Richardson P.C.

(57) ABSTRACT

A hydraulic fracturing operation is performed in a wellbore formed in a subterranean zone. A wellhead is installed at an entrance to the wellbore. Liquid $CO_2$ is flowed through a pipeline located at a surface and fluidically coupled to the wellhead. The liquid $CO_2$ is flowed into the wellbore through the wellhead to perform the hydraulic fracturing. The hydraulic fracturing operation including flowing of the liquid $CO_2$ through the pipeline to the wellhead is stopped. A portion of the liquid $CO_2$ is withdrawn from within the pipeline into a liquid $CO_2$ storage container, which is a portable system designed to capture and store liquid $CO_2$ and that is fluidically coupled to the pipeline at the surface.

15 Claims, 3 Drawing Sheets

(56) References Cited

OTHER PUBLICATIONS

Pursell, "Experimental investigation of high pressure liquid CO2 release behavior," In Hazards Symposium Series, Nov. 2012, 158, 164-171, 8 pages.
Reynolds et al., "First field application in Canada of carbon dioxide separation for hydraulic fracture flow back operations," SPE-167197, In SPE Unconventional Resources Conference Canada, OnePetro, Nov. 2013, 12 pages.
Ribeiro et al., "Lessons Learned from the Large-Scale CO2 Stimulation of 11 Unconventional Wells in the Williston Basin: A Practical Review of Operations, Logistics, Production Uplift, and CO2 Storage," SPE-209159-MS, In SPE Hydraulic Fracturing Technology Conference and Exhibition. OnePetro, 2022, 18 pages.
PCT Invitation to Pay Additional Fees in International Appln. No. PCT/US2023/083135, mailed on Apr. 26, 2024, 13 pages.

* cited by examiner

PORTABLE SYSTEM TO CAPTURE AND STORE LIQUID CARBON DIOXIDE

TECHNICAL FIELD

This disclosure relates to using carbon dioxide ($CO_2$), specifically liquid $CO_2$, in hydraulic fracturing operations.

BACKGROUND

Hydraulic fracturing is a technique to stimulate production of hydrocarbons through the wellbore and to safely extract energy from an underground well. Hydraulic fracturing operations involve injecting fluids (e.g., liquids and materials such as proppants) at high pressure into a wellbore formed in a subterranean zone (e.g., a formation, a portion of a formation, multiple formations). The fluids are injected at high pressure to create small fractures in the subterranean zone. The proppants keep the fractures in the open position. By doing so, hydrocarbon entrapped in the subterranean zone flows into the wellbore through the fractures. In some instances, the fluids injected into the wellbore include carbon dioxide ($CO_2$). Chemical interaction between the $CO_2$ and the subterranean zone, specifically the rock formation, especially under high pressure, can alter the pore structure of the rock matrix and aid in the dissolution of the rock matrix and in the migration of minerals.

In some instances, $CO_2$ in liquid state is used as one of the injection fluids. Liquid $CO_2$ is a fluid state of $CO_2$ in which the $CO_2$ is maintained at low temperatures (e.g., −34.4° C.) and high pressure (e.g., 1.406 MPa). Compared to gaseous $CO_2$, liquid $CO_2$ is easier to transport.

SUMMARY

This specification describes technologies relating to a portable system to capture and store liquid $CO_2$, e.g., liquid $CO_2$ used in hydraulic fracturing operations.

Certain aspects of the subject matter described here can be implemented as a method. A hydraulic fracturing operation is performed in a wellbore formed in a subterranean zone. A wellhead is installed at an entrance to the wellbore. Liquid $CO_2$ is flowed through a pipeline located at a surface and fluidically coupled to the wellhead. The liquid $CO_2$ is flowed into the wellbore through the wellhead to perform the hydraulic fracturing. The hydraulic fracturing operation including flowing of the liquid $CO_2$ through the pipeline to the wellhead is stopped. A portion of the liquid $CO_2$ is withdrawn from within the pipeline into a liquid $CO_2$ storage container that is fluidically coupled to the pipeline at the surface.

An aspect combinable with any other aspect includes the following features. After withdrawing the portion of the liquid $CO_2$ from the pipeline, the liquid $CO_2$ storage container is de-coupled from the pipeline. The liquid $CO_2$ storage container filled with the portion of the liquid $CO_2$ is transported away from the wellbore.

An aspect combinable with any other aspect includes the following features. The withdrawn portion of the liquid $CO_2$ is stored in the liquid state while transporting the liquid $CO_2$ storage container.

An aspect combinable with any other aspect includes the following features. To store the withdrawn portion of the liquid $CO_2$ in the liquid state, a temperature and a pressure of the liquid $CO_2$ container is maintained at a temperature and a pressure, respectively, at which $CO_2$ remains in liquid state.

An aspect combinable with any other aspect includes the following features. To flow the liquid $CO_2$ into the wellbore through the wellhead to perform the hydraulic fracturing, multiple liquid $CO_2$ containers, each carrying liquid $CO_2$, are coupled to an inlet of the pipeline. An outlet of the pipeline is coupled to the wellhead. A booster pump fluidically coupled to the pipeline is operated to flow the liquid $CO_2$ from the multiple liquid $CO_2$ containers to the wellhead.

An aspect combinable with any other aspect includes the following features. Each liquid $CO_2$ container is fluidically coupled to a manifold trailer fluidically coupled to the inlet of the pipeline.

An aspect combinable with any other aspect includes the following features. To withdraw a portion of the liquid $CO_2$ within the pipeline into a liquid $CO_2$ storage container fluidically coupled to the pipeline at the surface, a check valve is fluidically coupled to the pipeline at a location between the multiple liquid $CO_2$ containers and the wellhead. The check valve is operated to isolate a portion of the pipeline between the check valve and the wellhead. The portion of the liquid $CO_2$ within the isolated portion of the pipeline is withdrawn.

An aspect combinable with any other aspect includes the following features. A pipeline pump is fluidically coupled to the check valve and the liquid $CO_2$ container into which the portion of the liquid $CO_2$ is withdrawn. The pipeline pump is operated to draw the portion of the liquid $CO_2$ into the liquid $CO_2$ container.

Certain aspects of the subject matter described here can be implemented as a method that includes multiple steps. In step (a), a cemented liner of a first stage in a wellbore is perforated. In step (b), after perforating the cemented liner, slickwater fluid is flowed into the wellbore to initiate and propagate a fracture in the wellbore. In step (c), after initiating and propagating the fracture, proppant slurry is flowed into the wellbore. In step (d), after flowing proppant slurry into the wellbore, liquid $CO_2$ is flowed into the wellbore. After flowing the liquid $CO_2$ into the wellbore, a portion of the liquid $CO_2$ is withdrawn into a liquid $CO_2$ container. The liquid $CO_2$ is maintained in the liquid state in the liquid $CO_2$ container.

An aspect combinable with any other aspect includes the following features. To maintain the liquid $CO_2$ in the liquid state, the liquid $CO_2$ container is insulated to maintain a temperature and a pressure of the liquid $CO_2$ container at a temperature and a pressure, respectively, at which $CO_2$ remains in liquid state.

An aspect combinable with any other aspect includes the following features. To flow the liquid $CO_2$ into the wellbore, the liquid $CO_2$ is flowed into the wellbore through a pipeline located at a surface and fluidically coupled to the wellhead.

An aspect combinable with any other aspect includes the following features. To flow the liquid $CO_2$ through the pipeline, multiple liquid $CO_2$ containers, each carrying liquid $CO_2$, are coupled to an inlet of the pipeline. An outlet of the pipeline is coupled to the wellhead. A booster pump, which is fluidically coupled to the pipeline, is operated to flow the liquid $CO_2$ from the multiple liquid $CO_2$ containers to the wellhead.

An aspect combinable with any other aspect includes the following features. To withdraw a portion of the liquid $CO_2$ into the liquid $CO_2$ storage container, a check valve is fluidically coupled to the pipeline at a location between the multiple liquid $CO_2$ containers and the wellhead. The check valve is operated to isolate a portion of the pipeline between the check valve and the wellhead. The portion of the liquid $CO_2$ within the isolated portion of the pipeline is withdrawn.

An aspect combinable with any other aspect includes the following features. A pipeline pump is fluidically coupled to the check valve and the liquid $CO_2$ container into which the portion of the liquid $CO_2$ is withdrawn. The pipeline pump is operated to draw the liquid $CO_2$ within the isolated portion of the pipeline.

An aspect combinable with any other aspect includes the following features. Steps (a)-(d) form a fracturing stage. The hydraulic fracturing stage is stopped before withdrawing the portion of the liquid $CO_2$ into the liquid $CO_2$ container. After withdrawing the portion of the liquid $CO_2$ into the liquid $CO_2$ container, steps (a)-(d) are performed in a second, subsequent hydraulic fracturing stage.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Use of liquid $CO_2$ as one of the hydraulic fracturing fluids can enhance the efficiency of hydraulic fracturing operation. In addition, the injected $CO_2$ can be trapped in the subterranean zone and thereby be sequestered. Such sequestration of $CO_2$ can have positive environmental impact. Liquefying $CO_2$ and maintaining liquefied $CO_2$ in liquid form can necessitate the use of specialized equipment, e.g., equipment with appropriate insulation depending on the saturation temperature and pressure. Moreover, when implemented in hydraulic fracturing operations, the liquid $CO_2$ flows through equipment including flow equipment such as pipelines, valves, pumps, and the like. Continuous contact of such equipment with the liquid $CO_2$ can cause damage to the equipment due to the low temperature and high pressure of the liquid $CO_2$. One technique to reduce the continuous contact of the equipment with the liquid $CO_2$ is to bleed the $CO_2$ to the atmosphere. However, not only does doing so result in wastage of liquid $CO_2$, but the addition of $CO_2$ to the atmosphere also creates a negative environmental impact.

This disclosure describes technologies relating to a portable system to capture and store liquid $CO_2$, specifically liquid $CO_2$ used as in hydraulic fluids. Implementing the techniques described here can limit a need to vent $CO_2$ to the atmosphere, thereby creating a positive environmental impact. Implementing the techniques here can also reduce a contact time between hydraulic fracturing equipment and liquid $CO_2$. Such reduction in contact time can reduce damage to and increase the life of the equipment. The $CO_2$ captured using the techniques described here is maintained in liquid form, allowing the liquid $CO_2$ to be transported to different locations for storage or re-use.

Figure 1:
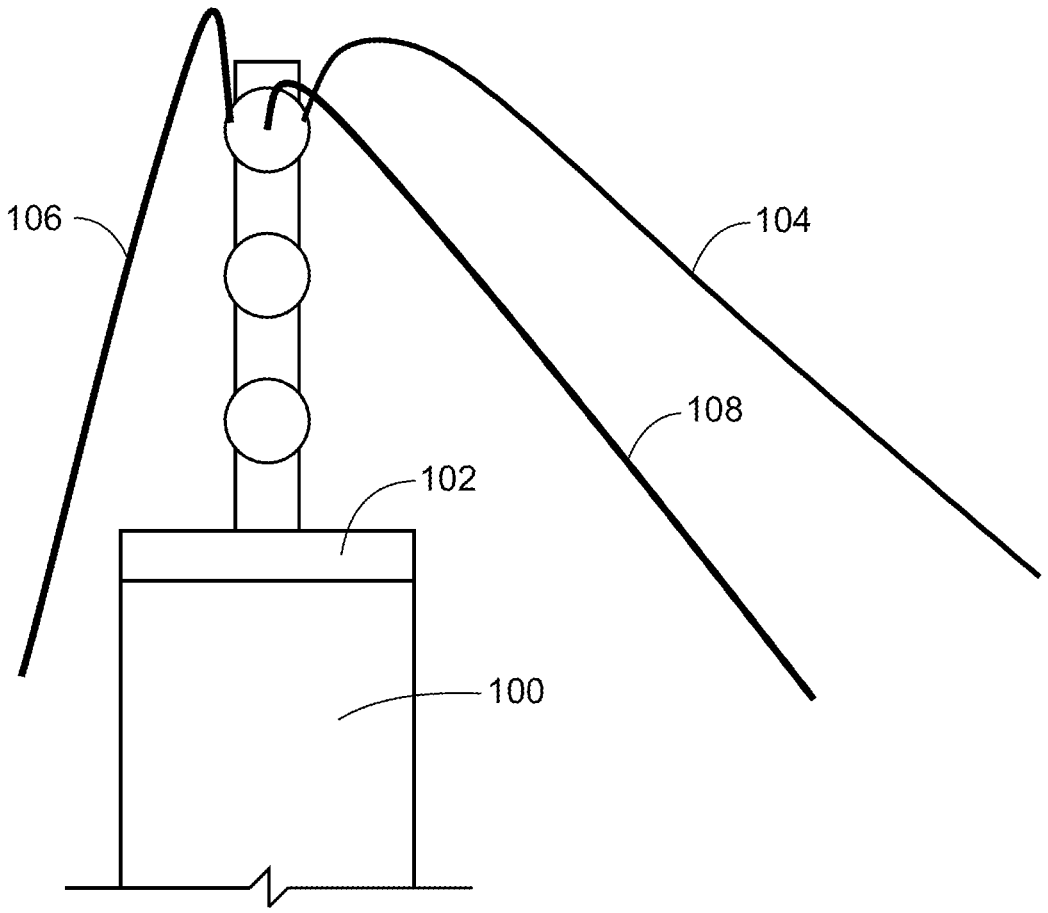
FIG. 1 is schematic diagram showing injecting different hydraulic fracturing fluids into a wellhead of a wellbore.

FIG. 1 is schematic diagram showing injecting different hydraulic fracturing fluids into a wellhead of a wellbore. Hydraulic fracturing operations can be performed in a pad of wells, the pad including four wells. The fracturing operations are performed in an alternating fashion in two wells at a time. In a hydraulic fracturing set up, a wellbore 100 is formed in a subterranean zone (not shown). A wellhead 102 (e.g., a Christmas tree with valves and pipeline fittings) is installed at the surface of the Earth at an inlet to the wellbore. Multiple pipelines are connected to the wellhead to flow different hydraulic fracturing fluids into the wellbore 100. For example, a first pipeline 104 flows slurry, which is a mixture of a fluid and proppants. A second pipeline 106 flows slickwater. A third pipeline 108 can flow liquid $CO_2$. Other pipelines to flow other hydraulic fracturing fluids or fluids for other well operations can be fluidically coupled to the wellhead.

In an example hydraulic fracturing sequence in two adjacent wells, a perforation gun is run into the wellbore 100 to perforate a cemented liner of the first stage in a first well (e.g., the wellbore 100). Then, slickwater fluid is flowed through the second pipeline 106 to initiate and propagate the fracture in the first well. Then, proppant slurry is flowed through the first pipeline 104 into the first well. Then, liquid $CO_2$ is flowed through the third pipeline 108 into the first well. The hydraulic fracturing operations described here represent a first stage of hydraulic fracturing. While the pumping steps (i.e., pumping the slickwater fluid, pumping the proppant slurry and pumping the liquid $CO_2$) are being conducted, the perforation step (i.e., running the perforation gun to perforate the cemented liner) is performed in the second well. Then, the pumping operations are performed in the second well. The sequence of operations is repeated for each hydraulic fracturing stage in an alternating fashion between the two wells.

Figure 2:
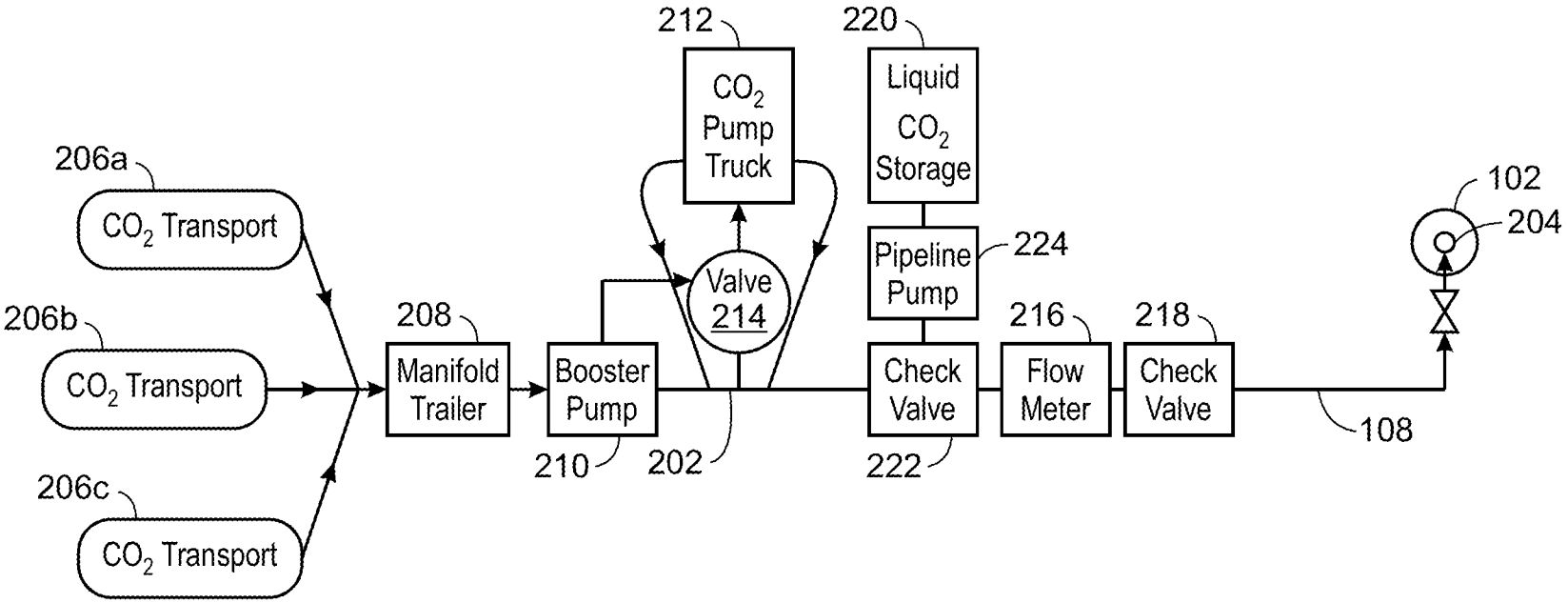
FIG. 2 is a schematic diagram showing injecting liquid $CO_2$ into the wellhead of FIG. 1.

FIG. 2 is a schematic diagram showing injecting liquid $CO_2$ into the wellhead 102. FIG. 2 schematically shows multiple equipment used to flow liquid $CO_2$ for hydraulic fracturing. For example, the liquid $CO_2$ is injected through the third pipeline 108 into the wellhead 102. The liquid $CO_2$ can be transported to the well site, e.g., to an inlet 202 of the third pipeline 108, with an outlet 204 of the third pipeline 108 connected to the wellhead 102. The location of the inlet 202 shown in FIG. 2 can be different in different implementations. For example, the liquid $CO_2$ can be transported in multiple containers (e.g., a first container 206*a*, a second container 206*b*, a third container 206*c* or more or fewer containers). Each container can be a tanker driven to the well site. At the well site, each container can be fluidically coupled to a manifold trailer 208 (e.g., a manifold) that can receive fluidic inlet connections from the multiple containers and include one fluidic outlet connection to the inlet 202 of the third pipeline 108. A booster pump 210 can be fluidically coupled to the manifold trailer 208 and to the inlet 202 of the third pipeline 108 to draw the liquid $CO_2$ from the multiple containers into the inlet 202 of the third pipeline 108.

A liquid $CO_2$ pump truck 212, which includes pumping equipment to pump the liquid $CO_2$ drawn from the multiple containers, is fluidically coupled to the third pipeline 108. The liquid $CO_2$ pump truck 212 is operated to flow the liquid $CO_2$ through the third pipeline 108 towards the wellhead 102. In some implementations, a valve 214 can be fluidically connected to the liquid $CO_2$ pump truck 212 and to the booster pump 210. The valve 214 can be operated to control a quantity of liquid $CO_2$ drawn from the multiple containers into the liquid $CO_2$ truck 212.

In some implementations, a flowmeter 216 is fluidically coupled to the third pipeline 108 downstream of the valve 214. The flowmeter 216 can be used to measure a volumetric flow rate of the liquid $CO_2$ through the third pipeline 108. Operations of the liquid $CO_2$ pump truck 212 or the booster pump 210 or both can be controlled based on measurements obtained from the flowmeter 216.

In some implementations, a check valve 218 is fluidically coupled to the third pipeline 108 upstream of the outlet 204 of the third pipeline 108 (e.g., downstream of the flowmeter 216). The check valve 218 can permit flow of the liquid $CO_2$ through the third pipeline 108 towards the outlet 204 of the third pipeline 108, and can prevent flow of the liquid $CO_2$ in the opposite direction towards the inlet 202 of the third pipeline 108.

When flow of the liquid $CO_2$ through the third pipeline 108 into the wellbore 100 through the wellhead 102 is stopped, then a quantity of liquid $CO_2$ remains in the third pipeline 108, specifically between the inlet 202 and the outlet 204. The fluidic properties of the liquid $CO_2$ (namely, the low temperature and high pressure) can have damaging effects on the equipment through which the liquid $CO_2$. Moreover, unless the temperature and pressure are maintained, the liquid $CO_2$ can transition to a different state or phase.

To avoid these drawbacks, in some implementations, a portion of the liquid $CO_2$ can be withdrawn from within the third pipeline 108 and collected in a portable liquid $CO_2$ container 220. The container 220 can be an insulated tank that can maintain a temperature of the liquid $CO_2$ at a temperature at which the liquid $CO_2$ remains in the same state/phase as when the liquid $CO_2$ was initially introduced into the third pipeline 108. In some implementations, the liquid $CO_2$ container 220 can be connected to refrigeration systems to maintain the liquid $CO_2$ at the low temperatures mentioned above.

The liquid $CO_2$ container 220 can be fluidically coupled to the third pipeline 108 to withdraw the portion of the liquid $CO_2$. For example, a check valve 222 can be fluidically coupled to the third pipeline 108 upstream of the check valve 218 and, in some implementations, upstream of the flowmeter 216. When hydraulic fracturing operations are being performed, the check valve 222 can permit the flow of the liquid $CO_2$ downstream of the check valve 222, and seal flow of the liquid $CO_2$ to the liquid $CO_2$ container 220. When hydraulic fracturing operations are stopped, the check valve 222 can switch operational states to seal the flow of the liquid $CO_2$ downstream of the check valve 222, and to divert flow of the liquid $CO_2$ into the liquid $CO_2$ container 220. In this manner, the check valve 222 can be operated to isolate a portion of the third pipeline 108 in which the liquid $CO_2$ resides. The isolated portion can be a length of the third pipeline 108 from the multiple liquid $CO_2$ containers to the check valve 222. Alternatively or in addition, the isolated portion can be a length of the third pipeline 108 from the check valve 222 to the outlet 204 attached to the wellhead 102. In some implementations, the entire length of the third pipeline 108 from the inlet 202 to the outlet 204 can be isolated to withdraw portions of the liquid $CO_2$ from the entire length of the third pipeline 108.

In some implementations, a pipeline pump 224 can be fluidically coupled between the check valve 222 and the liquid $CO_2$ container 220. When the check valve 222 is in the operational state that diverts flow of the liquid $CO_2$ into the liquid $CO_2$ container 220, the pipeline pump 224 can be operated to draw the liquid $CO_2$ from the third pipeline 108 and to pump the drawn liquid $CO_2$ into the liquid $CO_2$ container 220. Alternatively or in addition, the pipeline pump 224 can pressurize the liquid $CO_2$ in the liquid $CO_2$ container 220 to a pressure at which the liquid $CO_2$ remains in the same state/phase as when the liquid $CO_2$ was initially introduced into the third pipeline 108.

In an example operation of withdrawing the portion of the liquid $CO_2$ into the liquid $CO_2$ container 220, after the booster pump 210 and/or the $CO_2$ pump truck 212 pumps the liquid $CO_2$ from the multiple containers into the third pipeline 108, the pumps are shut-in. The check valve 218 is closed. The multiple containers are also closed. The check valve 222 is opened and the pipeline pump 224 is run. Once the liquid $CO_2$ container 220 fills to a desired level, the pipeline pump 224 is shut-in and the check valve 222 is closed. This example operation is repeated as desired, e.g., after each fracturing stage.

Figure 3:
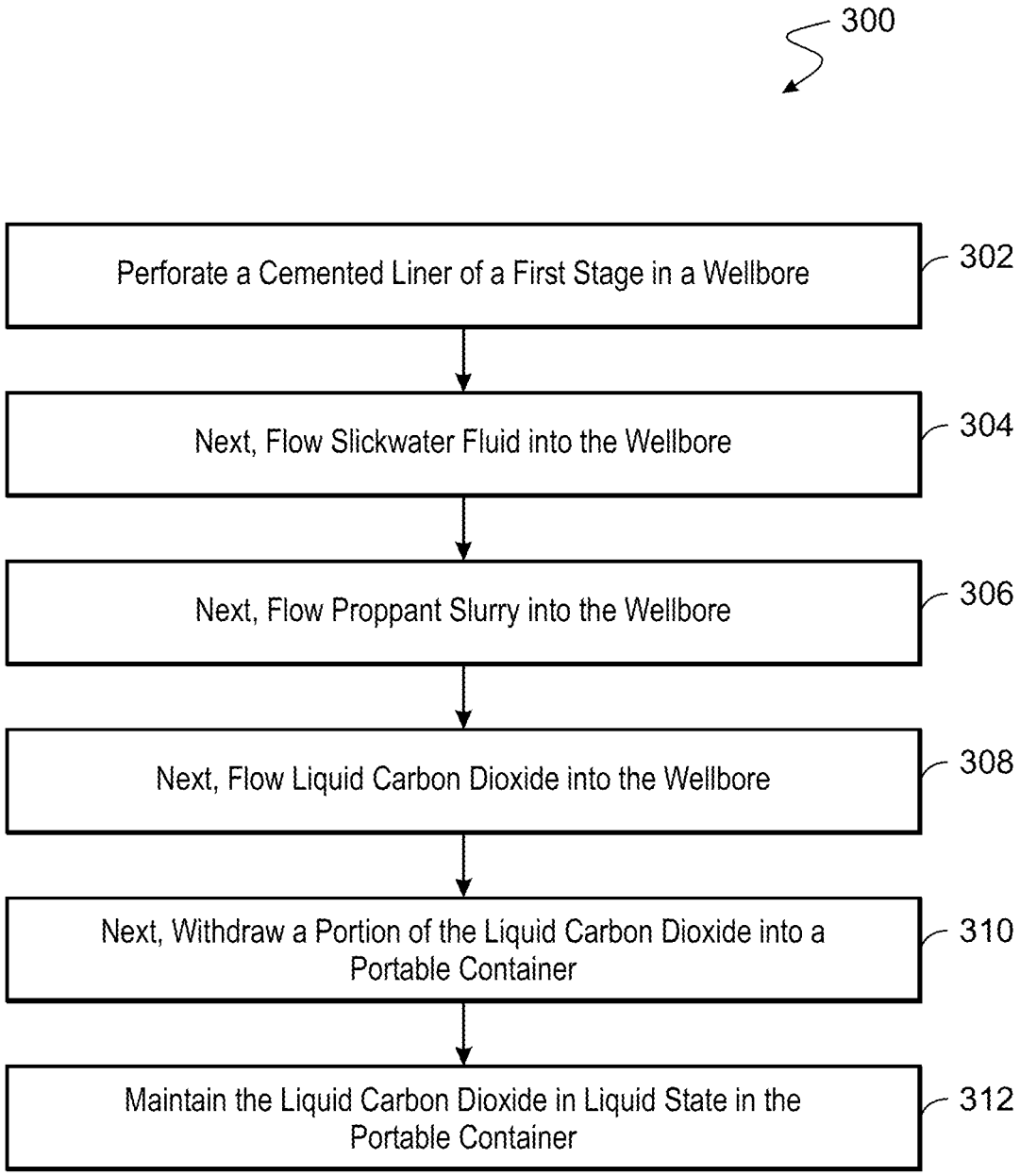
FIG. 3 is a flowchart of an example of a process of withdrawing liquid $CO_2$ that is injected into the wellhead of the wellbore.

FIG. 3 is a flowchart of an example of a process 300 of withdrawing liquid $CO_2$ that is injected into the wellhead of the wellbore. In some implementations, the process 300 can be performed by an operator, e.g., a hydraulic fracturing equipment operator. At 300, a cemented liner of a first stage in a wellbore is perforated. Next, at 304, slickwater fluid is flowed into the wellbore. Next, at 306, proppant slurry is flowed into the wellbore. Next, at 308, liquid $CO_2$ is flowed into the wellbore. Next, at 310, a portion of the liquid $CO_2$ is withdrawn into a portable container. Next, at 312, the liquid $CO_2$ is maintained in the liquid state in the portable container, e.g., by using necessary insulation, refrigeration and pressurization.

After withdrawing the liquid $CO_2$ into the container, the container can be separated, i.e., de-coupled from the pipeline from which the liquid $CO_2$ was withdrawn. The insulation and refrigeration can maintain the temperature of the liquid $CO_2$. The container can be sealed appropriately to maintain the pressure of the liquid $CO_2$. The container, de-coupled from the pipeline, can be transported to any location, e.g., a location away from the wellbore, while the liquid $CO_2$ is maintained in the same state as it was when introduced into the pipeline. The liquid $CO_2$ can be stored at that location. Alternatively, the container can be coupled to different equipment, e.g., hydraulic fracturing equipment at a different well site, to flow the liquid $CO_2$ out of the container into the other equipment.

In some implementations, the liquid $CO_2$ can be replaced with supercritical $CO_2$. In the supercritical state, $CO_2$ has viscosity like gas and density like water. In such implementations, the liquid $CO_2$ container 220 can be modified to maintain the $CO_2$ in the supercritical state. For example, the $CO_2$ container can be fitted with airtight blender, high pressure pump and manifold trucks that can maintain the $CO_2$ in supercritical condition. Remaining equipment described here can also be similarly modified to accommodate supercritical $CO_2$ in place of liquid $CO_2$.

Thus, particular implementations of the subject matter have been described. Other implementations are within the scope of the following claims.

The invention claimed is:

1. A method comprising:

while performing a hydraulic fracturing operation in a wellbore formed in a subterranean zone, a wellhead installed at an entrance to the wellbore, flowing, through a pipeline located at a surface and fluidically coupled to the wellhead, liquid $CO_2$ into the wellbore through the wellhead to perform the hydraulic fracturing;

stopping the hydraulic fracturing operation including stopping flow of the liquid $CO_2$ through the pipeline to the wellhead; and withdrawing a portion of the liquid $CO_2$ within the pipeline into a liquid $CO_2$ storage container fluidically coupled to the pipeline at the surface.

2. The method of claim 1, further comprising:

after withdrawing the portion of the liquid $CO_2$ from the pipeline, de-coupling the liquid $CO_2$ storage container from the pipeline; and transporting the liquid $CO_2$ storage container filled with the portion of the liquid $CO_2$ away from the wellbore.

3. The method of claim 2, further comprising storing the withdrawn portion of the liquid $CO_2$ in liquid state while transporting the liquid $CO_2$ storage container.

4. The method of claim 3, wherein storing the withdrawn portion of the liquid $CO_2$ in the liquid state comprises maintaining a temperature and a pressure of the liquid $CO_2$ container at a temperature and a pressure, respectively, at which $CO_2$ remains in liquid state.

5. The method of claim 1, wherein flowing the liquid $CO_2$ into the wellbore through the wellhead to perform the hydraulic fracturing comprises:

coupling a plurality of liquid $CO_2$ containers, each carrying liquid $CO_2$, to an inlet of the pipeline, an outlet of the pipeline coupled to the wellhead; and operating a booster pump fluidically coupled to the pipeline to flow the liquid $CO_2$ from the plurality of liquid $CO_2$ containers to the wellhead.

6. The method of claim 5, further comprising fluidically coupling each liquid $CO_2$ container to a manifold trailer fluidically coupled to the inlet of the pipeline.

7. The method of claim 5, wherein withdrawing the portion of the liquid $CO_2$ within the pipeline into the liquid $CO_2$ storage container fluidically coupled to the pipeline at the surface comprises:

fluidically coupling a check valve to the pipeline at a location between the plurality of liquid $CO_2$ containers and the wellhead;

operating the check valve to isolate a portion of the pipeline between the check valve and the wellhead; and withdrawing the portion of the liquid $CO_2$ within the isolated portion of the pipeline.

8. The method of claim 7, further comprising:

fluidically coupling a pipeline pump to the check valve and the liquid $CO_2$ container into which the portion of the liquid $CO_2$ is withdrawn; and operating the pipeline pump to draw the portion of the liquid $CO_2$ into the liquid $CO_2$ container.

9. A method comprising:

(a) perforating a cemented liner of a first stage in a wellbore;

(b) after perforating the cemented liner, flowing slickwater fluid into the wellbore to initiate and propagate a fracture in the wellbore;

(c) after initiating and propagating the fracture, flowing proppant slurry into the wellbore;

(d) after flowing proppant slurry into the wellbore, flowing liquid $CO_2$ into the wellbore;

after flowing the liquid $CO_2$ into the wellbore, withdrawing a portion of the liquid $CO_2$ into a liquid $CO_2$ container; and maintaining the liquid $CO_2$ in the liquid $CO_2$ container in a liquid state.

10. The method of claim 9, wherein maintaining the liquid $CO_2$ in the liquid state comprises insulating the liquid $CO_2$ container to maintain a temperature and a pressure of the liquid $CO_2$ container at a temperature and a pressure, respectively, at which $CO_2$ remains in liquid state.

11. The method of claim 9, wherein flowing the liquid $CO_2$ into the wellbore comprises flowing, through a pipeline located at a surface and fluidically coupled to the wellhead, the liquid $CO_2$ into the wellbore through the wellhead.

12. The method of claim 11, wherein flowing the liquid $CO_2$ through the pipeline comprises:

coupling a plurality of liquid $CO_2$ containers, each carrying liquid $CO_2$, to an inlet of the pipeline, an outlet of the pipeline coupled to the wellhead; and operating a booster pump fluidically coupled to the pipeline to flow the liquid $CO_2$ from the plurality of liquid $CO_2$ containers to the wellhead.

13. The method of claim 12, wherein withdrawing the portion of the liquid $CO_2$ into the liquid $CO_2$ container comprises:

fluidically coupling a check valve to the pipeline at a location between the plurality of liquid $CO_2$ containers and the wellhead;

operating the check valve to isolate a portion of the pipeline between the check valve and the wellhead; and withdrawing the portion of the liquid $CO_2$ within the isolated portion of the pipeline.

14. The method of claim 13, further comprising:

fluidically coupling a pipeline pump to the check valve and the liquid $CO_2$ container into which the portion of the liquid $CO_2$ is withdrawn; and operating the pipeline pump to draw the portion of the liquid $CO_2$ into the liquid $CO_2$ container.

15. The method of claim 9, wherein steps (a)-(d) comprise a hydraulic fracturing stage, wherein the method further comprises:

stopping the hydraulic fracturing stage before the withdrawing the portion of the liquid $CO_2$ into the liquid $CO_2$ container; and after the withdrawing the portion of the liquid $CO_2$ into the liquid $CO_2$ container, performing steps (a)-(d) in a second, subsequent hydraulic fracturing stage.

* * * * *